US011980284B2

(12) United States Patent
Buettgen

(10) Patent No.: US 11,980,284 B2
(45) Date of Patent: May 14, 2024

(54) CREMATORY BRUSH

(71) Applicant: John J. Buettgen, Schofield, WI (US)

(72) Inventor: John J. Buettgen, Schofield, WI (US)

( * ) Notice: Subject to any disclaimer, the term of this patent is extended or adjusted under 35 U.S.C. 154(b) by 181 days.

(21) Appl. No.: 17/491,168

(22) Filed: Sep. 30, 2021

(65) Prior Publication Data

US 2023/0093907 A1 Mar. 30, 2023

(51) Int. Cl.
*A46B 9/02* (2006.01)
*A46B 3/16* (2006.01)
(Continued)

(52) U.S. Cl.
CPC ..... *A46B 9/026* (2013.01); *A46B 3/16* (2013.01); *A46B 7/00* (2013.01); *A46D 1/0207* (2013.01);
(Continued)

(58) Field of Classification Search
CPC ..... A46B 5/0004; A46B 5/002; A46B 7/00; A46B 7/02; A46B 7/023; A46B 9/026;
(Continued)

(56) References Cited

U.S. PATENT DOCUMENTS 1,490,078 A * 4/1924 Neff ..... A46B 3/00 15/194
1,749,733 A * 3/1930 Cave ..... A46B 5/00 15/160
(Continued)

FOREIGN PATENT DOCUMENTS

DE 102014005864 A1 * 10/2015 ..... A46B 7/04
EP 3789722 A1 * 3/2021 ..... F28G 1/16
(Continued)

OTHER PUBLICATIONS

Rake Out Strip Brush ("NPL-1"). Catalog Listing [online]. FRSR Crematory Repair, Service & Parts, Jul. 29, 2021 [retrieved on May 17, 2023]. Retrieved from the Internet: <URL: https://web.archive.org/web/20210729131917/https://www.frsr.us/store/p19/Rake_Out_Strip_Brush.html>. (Year: 2021).*
(Continued)

*Primary Examiner* — Steven M Cernoch
*Assistant Examiner* — Jonathan R Zaworski
(74) *Attorney, Agent, or Firm* — Stiennon & Stiennon

(57) ABSTRACT

A brush for removing cremated remains from a crematory oven is entirely formed of metal to resist the high temperatures of the oven and has two linear brush assemblies fixed to a top frame. A steel handle extends rearwardly from the frame for grasping by a brush operator. One of the linear brush assemblies has smaller diameter crimped stainless steel bristles and is positioned at the front of the brush, the other of the linear brush assemblies has larger diameter crimped stainless steel bristles and is fixed to the top frame rearward of the front brush assembly. Side brush assemblies extend sidewardly and upwardly of the other two. In operation the brush is inserted at the front of the oven and drawn rearwardly after the cremation such that the rear bristles encounter and withdraw the larger elements of the remains, and the front bristles encounter and withdraw the smaller elements.

20 Claims, 4 Drawing Sheets

(51) Int. Cl.
*A46B 7/00* (2006.01)
*A46D 1/00* (2006.01)
*F23J 1/04* (2006.01)
*F23G 1/00* (2006.01)

(52) U.S. Cl.
CPC ..... *A46D 1/0253* (2013.01); *F23J 1/04* (2013.01); *A46B 2200/3073* (2013.01); *F23G 1/00* (2013.01); *F23G 2900/7009* (2013.01)

(58) Field of Classification Search
CPC ..... A46B 2200/302; A46B 9/025; A46B 2200/3073; A46B 2200/3093; A46D 1/0207; A47L 13/06; A47L 13/34; F23G 1/00; F23G 900/7009; F23J 1/00; F23J 1/04
USPC ..... 15/159.1–160, 207.2, 236.09, 93.1–93.2; 110/170, 194; 56/400.17
See application file for complete search history.

(56) References Cited

U.S. PATENT DOCUMENTS 1,761,180 A * 6/1930 Cave ..... A47L 1/06 15/117
2,043,758 A * 6/1936 Lay ..... A46B 9/06 15/159.1
2,116,441 A * 5/1938 Mason ..... A47L 13/24 15/147.1
2,152,358 A * 3/1939 Palmeri ..... A46B 3/18 15/168
2,561,025 A * 7/1951 Le Febvre ..... A46B 5/00 15/205
2,855,618 A * 10/1958 Jones ..... A46B 9/02 15/160
2,958,888 A * 11/1960 Peterson ..... A46B 5/00 15/171
3,129,944 A * 4/1964 Amos ..... A63C 19/04 52/177
3,134,129 A * 5/1964 Allen ..... A47L 13/22 15/418
3,296,643 A * 1/1967 Fortune ..... E04H 4/1609 15/160
4,606,091 A * 8/1986 Sartori ..... A46D 3/04 15/159.1
4,763,378 A * 8/1988 Drumm ..... A46B 3/08 15/146
4,785,489 A * 11/1988 Von Doehren ..... A46B 5/0062 15/159.1
4,882,802 A * 11/1989 LeVere, Jr. ..... B25G 3/26 15/160
5,182,830 A * 2/1993 Viola ..... E01H 1/02 15/160
5,621,940 A * 4/1997 Lewis ..... A46B 7/04 15/202
6,088,865 A * 7/2000 Truan ..... E01H 1/02 15/190
6,108,854 A * 8/2000 Dingert ..... A46B 9/02 15/159.1
6,148,466 A * 11/2000 Smitelli, III ..... E04H 4/1609 D4/130
6,199,241 B1 * 3/2001 Anumah ..... A46B 9/02 15/160
7,065,947 B1 * 6/2006 Street ..... E01H 1/02 56/378
8,024,833 B2 * 9/2011 Fuller ..... A46D 1/0207 15/160
8,321,988 B1 * 12/2012 Randall ..... A46B 9/02 15/160
8,402,590 B1 * 3/2013 Larson ..... A46B 9/028 15/160
8,528,146 B1 * 9/2013 Abrahamson ..... A46B 5/0045 15/160
8,739,348 B1 * 6/2014 Currier ..... A46B 5/02 15/171
10,188,200 B1 * 1/2019 Hetzner ..... A46B 9/10
10,188,201 B1 * 1/2019 Schechter ..... A46B 5/0095
10,244,859 B2 * 4/2019 Robertson ..... B24B 7/188
11,284,704 B2 * 3/2022 Berrouard ..... A46B 9/06
2004/0031116 A1 * 2/2004 Coleman ..... B25G 3/04 15/175
2006/0265826 A1 * 11/2006 Kaminstein ..... A46B 7/04 15/176.1
2012/0279520 A1 * 11/2012 Sarris ..... A46D 1/0207 134/6
2014/0007366 A1 * 1/2014 Saccoccio ..... A46D 1/02 15/160
2018/0087490 A1 * 3/2018 Fraughton ..... B08B 1/12
2020/0275766 A1 * 9/2020 Buckley ..... A46B 7/046

FOREIGN PATENT DOCUMENTS

ES 2752623 T3 * 4/2020 ..... A46B 9/025
GB 2539880 A * 1/2017 ..... A46B 15/00
WO WO-9610718 A1 * 4/1996 ..... F23G 1/00
WO WO-2005079628 A1 * 9/2005 ..... A46B 15/0081

OTHER PUBLICATIONS

"Pool Telescopic Pole", Specials archive—Aldi—Australia, http://offers.kd2.org/en/au/aldi/pjTv/ , downloaded Sep. 30, 2021.
"Crematory Clean Out Brush-Angled with Scraper", http://www.lynchsupply.com/Crematory_Equipment_Supplies_s/2622.htm, downloaded prior to Jun. 8, 2021.
Poolmaster Brushes, poolmaster.com/product/maintenance/brushes/18inch-flexible-body-brush and poolmaster.com/product/maintenance/brushes/eighteen-inch-vinyl-liner-brush-with-bumper/, downloaded prior to Jun. 8, 2021.

* cited by examiner

CREMATORY BRUSH

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to apparatus for collecting the cremated remains of a deceased person (called "the decedent") from a mortuary crematory oven.

When a decedent is to be cremated, the body, usually within a coffin, box, or other container, is introduced into a high temperature crematory oven, and subjected to temperatures which may reach over 1,800 degrees F. The crematory oven is an industrial furnace lined with refractory brick and a having a delicate ceramic floor. After the body has been subjected to flames for one to two hours, the cremated remains on the oven floor must be removed from the oven. The remains will include larger components including bone fragments and metal as well as smaller particles akin to ash or dust.

The technician who operates the crematory oven and removes the remains must approach an intense heat, and hence it is desirable that the time required to carry out the removal of the remains be kept to a minimum. Yet it is important that a level of decorum and respect be shown to the remains. While the clearing of the oven should be as complete is possible, care must be taken not to damage the oven floor.

SUMMARY OF THE INVENTION

The crematory brush of this invention has a pair of parallel metal channel back brushes mounted at an angle to a top frame so the bristles extend away from the pole-like brush handle. The brush closest to the handle has heavier stainless steel bristles best suited to engaging the hotter and heavier larger particles of cremated remains, the second brush spaced farther from the handle has lighter stainless steel bristles well suited to engaging smaller particulate matter. The operator thus sweeps out larger and smaller particles in a single pull of the brush device. Side brush assemblies are fixed with respect to the top frame and extend sidewardly and upwardly of the other two. In operation the brush is inserted through the oven opening and drawn out after the cremation such that the heavier bristles encounter and withdraw the larger elements of human remains, and the lighter bristles encounter and withdraw the smaller elements of remains. The side brushes limit the sideward escape of material as the brush device is operated, and are especially helpful in crematory ovens having angled transition segments between the oven horizontal floor and vertical side walls.

It is an object of the present invention to provide a durable crematory brush device which endures high temperatures.

It is another object of the present invention to provide a crematory brush device which is usable on an oven surface prone to marring.

It is a further object of the present invention to provide a crematory brush device which can sweep both heavier and lighter particles.

Further objects, features and advantages of the invention will be apparent from the following detailed description when taken in conjunction with the accompanying drawings.

DESCRIPTION OF THE PREFERRED EMBODIMENTS

Figure 1:
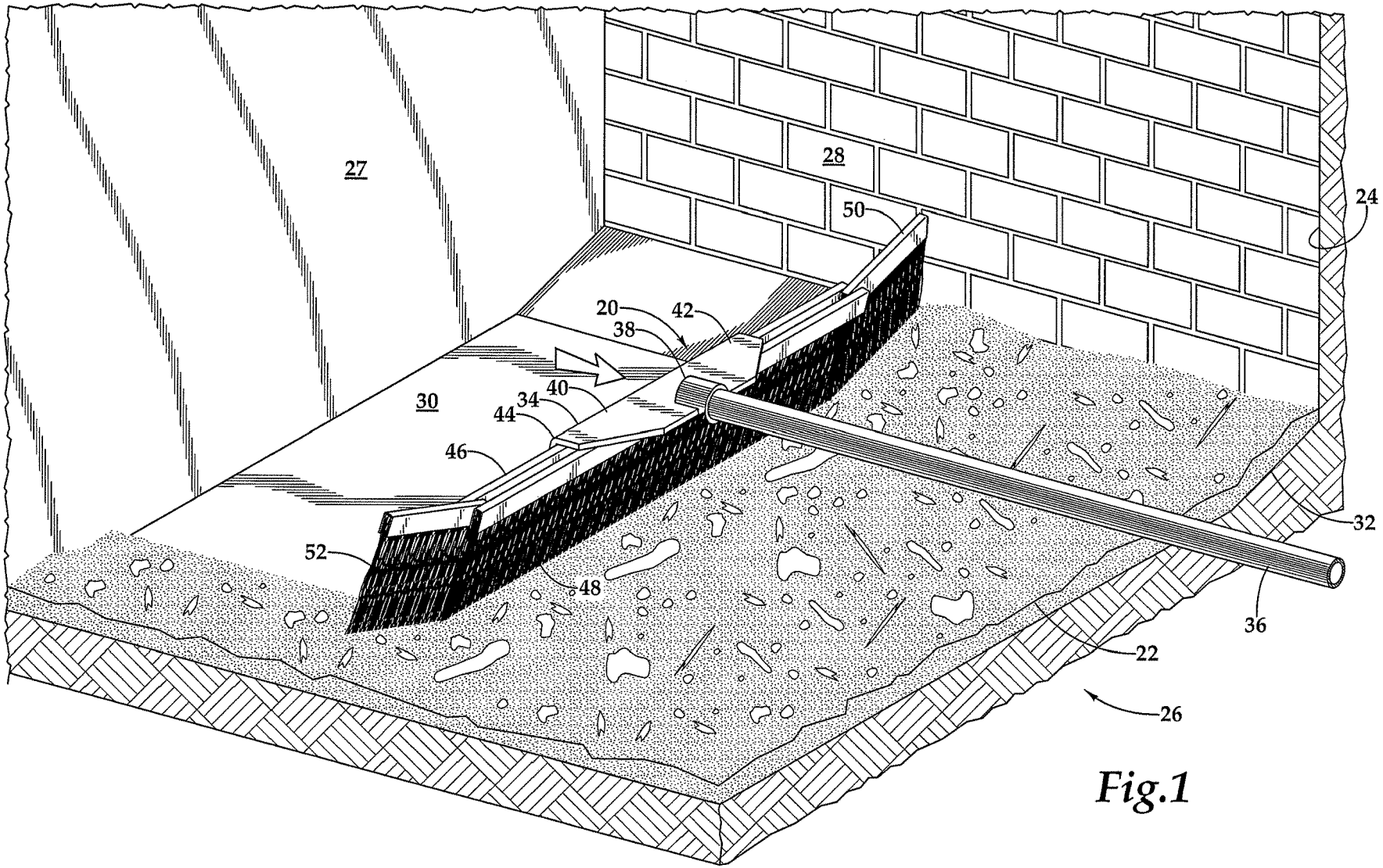
FIG. 1 is a rear isometric view of the crematory brush device of this invention removing the cremated remains of a decedent from the retort of a crematory oven, shown partially broken away.
Figure 2:
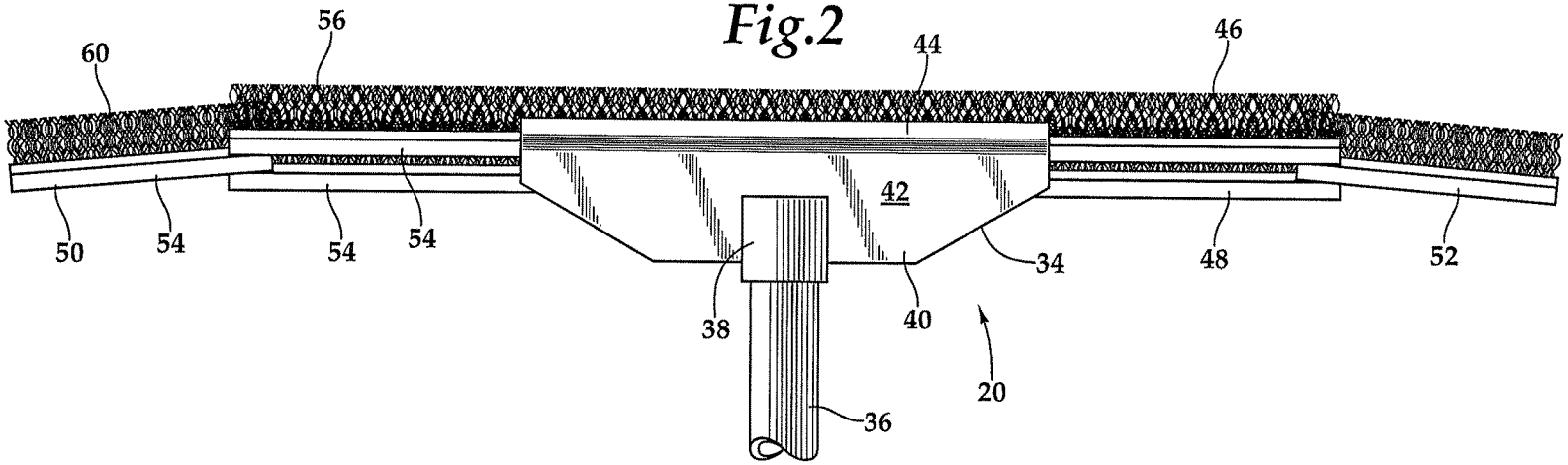
FIG. 2 is a top plan view of the crematory brush of FIG. 1.
Figure 3:
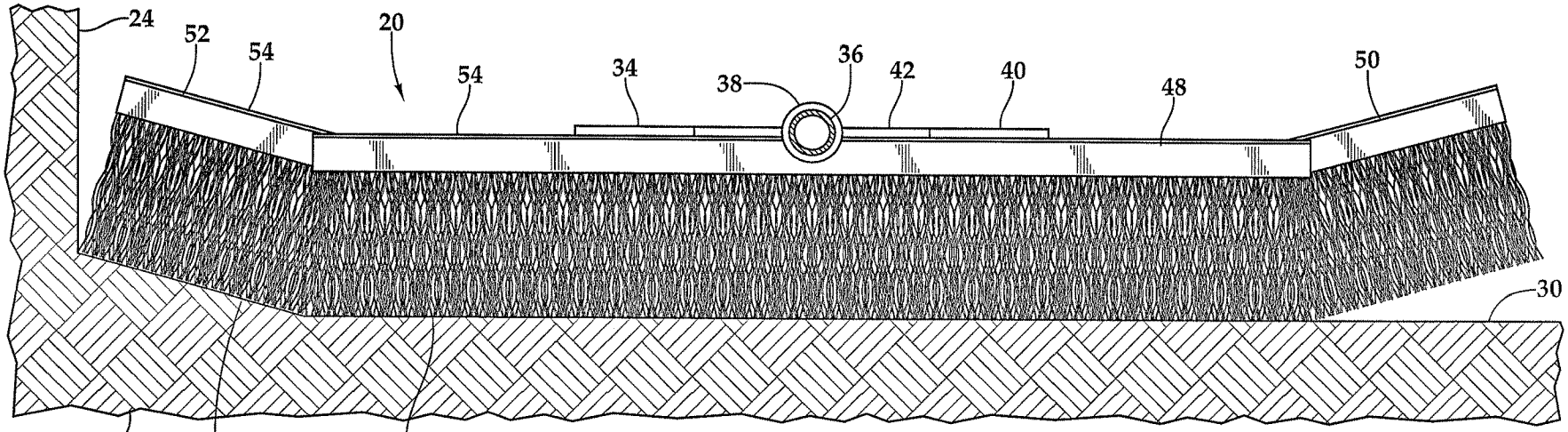
FIG. 3 is a rear elevational view of the crematory brush of FIG. 2 shown with respect to the crematory retort in section view.

Referring more particularly to FIGS. 1-6, wherein like numbers refer to similar parts, a crematory brush device 20 is shown in the process of removing the cremated remains 22 of a human from the retort 24 of a crematory oven 26 in FIG. 1. The elevated retort 24 is formed within the crematory oven 26 having side walls 28 of refractory brick which extend upwardly from a continuous floor 30 of a cement-like material. The floor 30 engages the side walls 28 at transition segments 32 which are at approximately a 45-degree angle and which extend between the horizontal floor and the vertical side walls, as shown in FIG. 3. The oven 26 has a closed end 27 and an opening (not shown) through which the decedent in introduced into the oven for cremation and through which the remains are removed with the crematory brush device.

Figure 5:
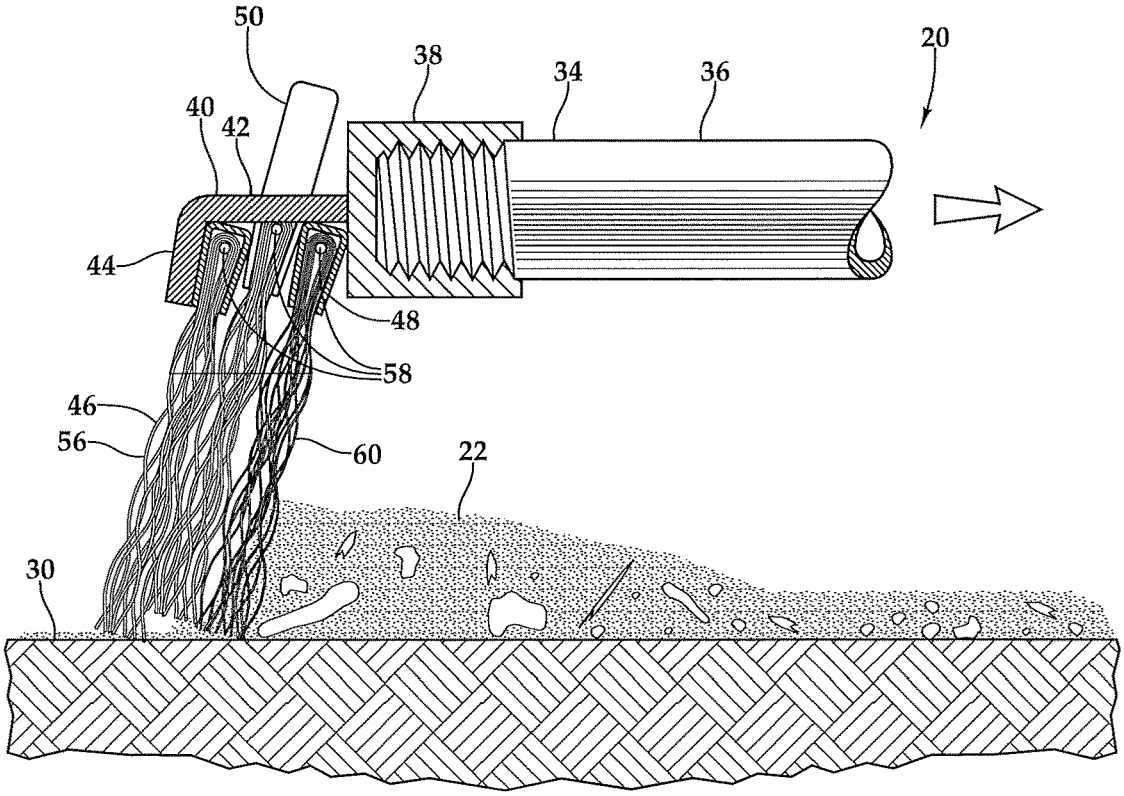
FIG. 5 is an enlarged cross-sectional view of the crematory brush of FIG. 2 taken along section line 5-5.
Figure 5A:
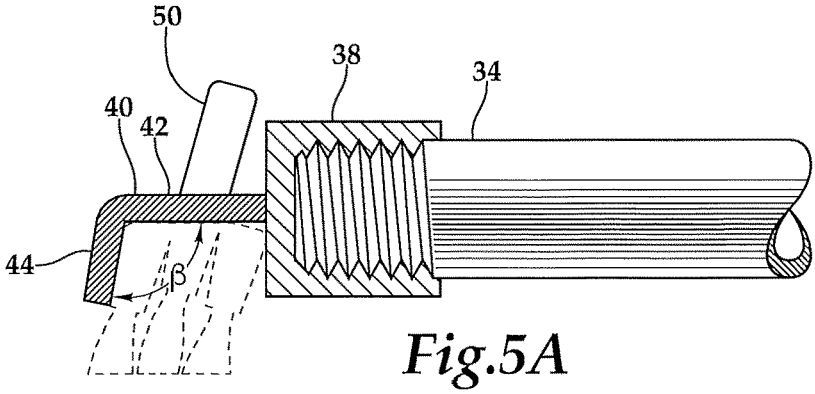
FIG. 5*a* is a fragmentary view of the crematory brush of FIG. 5 in which the brush assemblies have been shown in broken lines and an angle measurement has been indicated.

As shown in FIG. 1, the crematory brush device 20 has a brush head 34 with a cylindrical pipelike handle 36 having a threaded end which is received within a fitting 38 which is secured to a rigid top frame 40. The top frame 40 has a top plate 42 which extends generally parallel to the retort floor 30 in use. As shown in FIG. 5, a front plate 44 extends downwardly and frontwardly from the top plate 42 at an angle β of from 100 to 110 degrees, preferably about 105 degrees, as shown in FIG. 5*a*.

Figure 4:
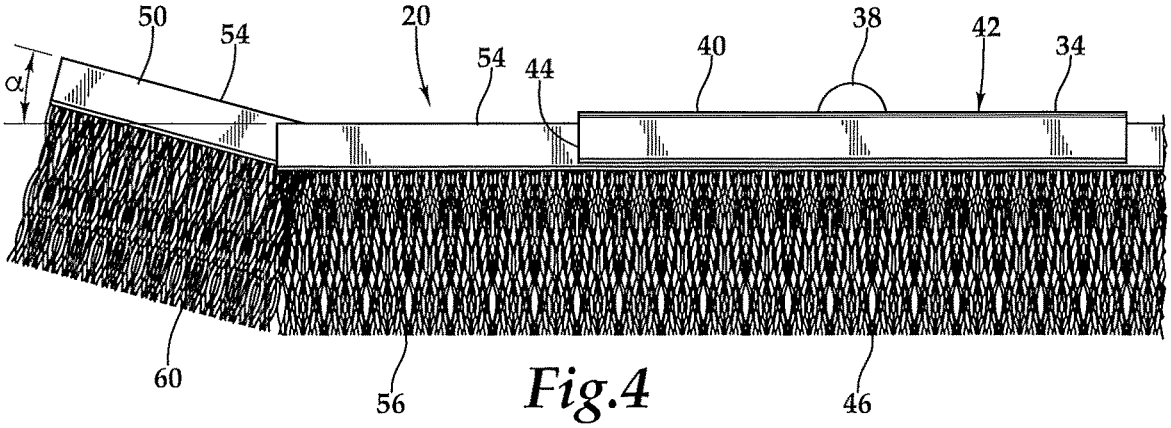
FIG. 4 is a fragmentary front elevational view of the crematory brush of FIG. 2.

The brush head 34 has four brush assemblies 46, 48, 50, 52 each of which is a conventional strip brush. Each strip brush has a generally U-shaped channel back 54 which receives an array of metal fills or bristles 56 or 60 which are folded around a center wire 58. The walls of the channel back 54 are deformed inwardly to thereby retain the bristles 56 or 60. As shown in FIGS. 4 and 5, the front brush assembly 46 is a linear brush which is secured to the top frame 40 to abut the front plate 44. The rear brush assembly 48 is also a linear brush of substantially the same length as the front brush assembly, and is secured to the top frame 40 disposed parallel to and rearward of the front brush assembly 46. Two side brush assemblies 50, 52 are positioned between the front brush assembly 46 and the rear brush assembly 48. The side brush assemblies 50, 52 are shorter than the front and rear brush assemblies, and each extends upwardly and outwardly from the front brush assembly and the rear brush assembly as shown in FIGS. 2 and 3. The metal channel back 54 of the front brush assembly 46 defines a horizontal level. As shown in FIG. 4, the channel back 54 of each side brush assembly 50, 52 is inclined upwardly an angle $\alpha$ of about thirty degrees from the horizontal level.

As shown in FIG. 5, all the brush assemblies, being parallel to the front plate 44 and are all tipped away from the handle and are thus inclined from the vertical. This tipping reduces the tendency of the swept material to kick out at the operator as the remains are drawn out of the crematory oven.

Each of the four brush assemblies has a particular function within the brush head 34. The rear brush assembly 48, as shown in FIG. 5, has stainless steel crimped bristles which are the first to engage the cremated remains 22 when the brush head is introduced into the retort 24 in proximity to the closed end 27 of the oven 26. It must be noted that the oven 26 is extremely hot and does not have time to cool down after cremation is complete. Hence the brush device 20 must be able to endure these high temperatures. Moreover, to reduce the time of exposure of the oven operator to the high temperatures of the oven interior, the brush device 20 should be able to expeditiously and thoroughly remove the cremated remains. The cremated remains will not be uniform in consistency, but will include larger elements, such as fragments of bone and other inclusions, as well as fine dust-like elements. The larger elements tend to retain heat more effectively, and it is these elements which are encountered by the rear bristles 60. The rear bristles are thus of a diameter sufficient to endure the hot elements they are called upon to sweep out of the oven, and are preferably formed of stainless steel of 0.020 inch diameter crimped stainless steel fill bristles. The front bristles 56 are lighter stainless steel crimped fill bristles, for example, 0.0118 diameter. The rear bristles are preferably at least 50 percent larger in diameter than the front bristles. The front bristles 56 engage and sweep out the finer cremated particles and are less prone to damage the oven floor. Their lighter weight allows them to glide over the oven floor without damaging it, while carrying the dust along. The finer front bristles 56 are generally isolated from contact with the hotter large particles which are swept by the heavier rear bristles. The angling of all the brush assemblies away from the handle helps to keep material from kicking out from the brush.

The side brush assemblies 50, 52 restrain material from escaping sidewardly from the brush head as it is drawn alongside an oven side wall. The side brush assemblies may be fitted with heavy bristles 60 similar to those in the rear brush assembly 48. About three pulls will be required to clear the remains from the crematory oven.

Figure 6:
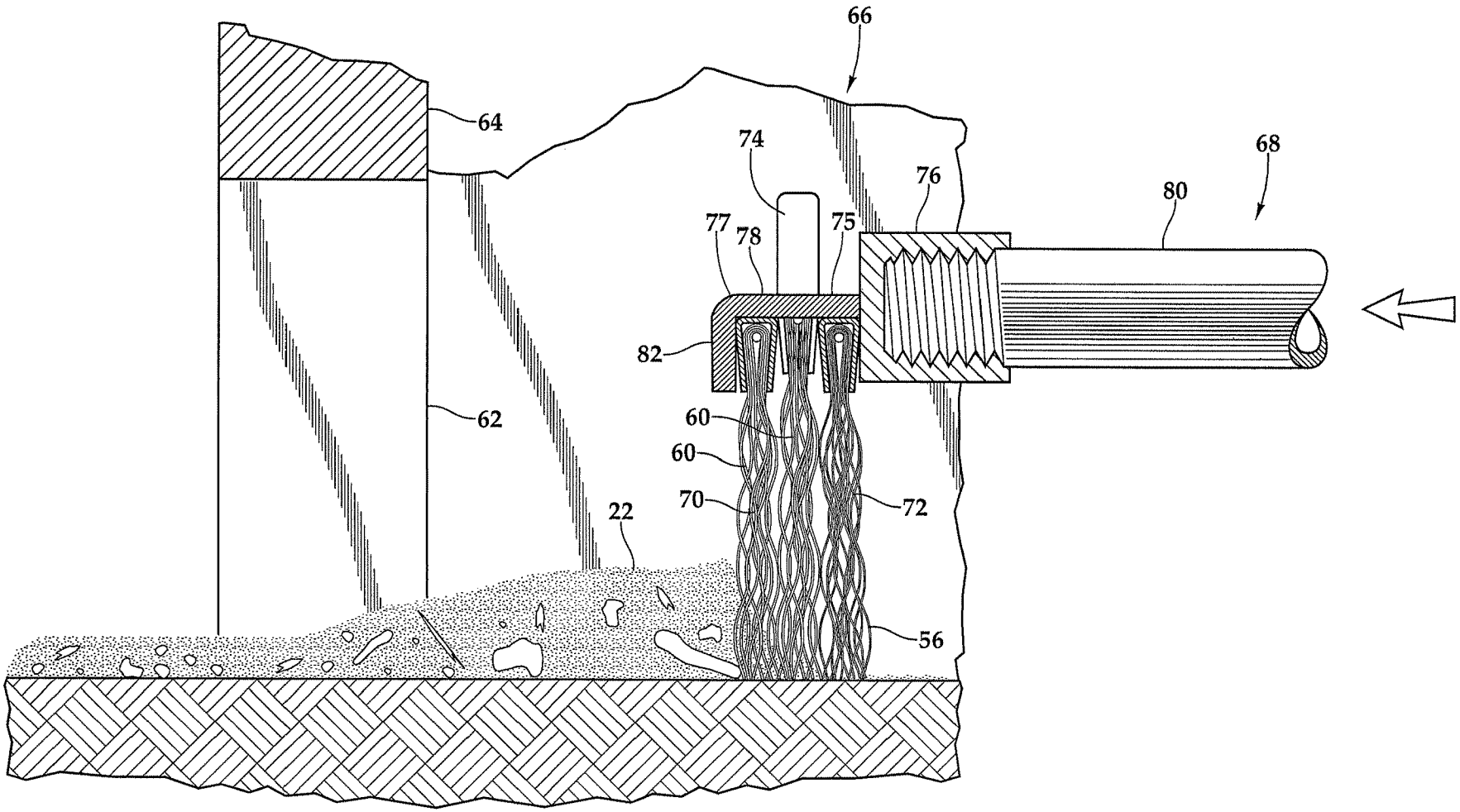
FIG. 6 is a cross-sectional view of an alternative embodiment crematory brush for use within a clean-out opening in the closed wall of the crematory oven.

As shown in FIG. 6, in some crematory ovens, the remains 22 are not drawn out of the oven entrance but instead are pushed along the oven floor 61 out an exit opening 62 in the rear wall 64 of the crematory oven 66. An alternative embodiment crematory brush device 68 is adapted for use in this configuration in which the operator pushes the device rather than pulls it. The push brush device 68 is similar to the device 20 but it is not required that the brush assemblies be tilted because the remains are always remote from the brush operator and there is no concern of the remains kicking out on to the operator. In the brush device 68 the front brush assembly 70 has heavy bristles 56, as it encounters the heavier remains first, and the rear brush assembly 72 has lighter bristles 56 for engaging the lighter remains. The side brush assemblies 74 are positioned between the front and rear brush assemblies and extend upwardly at the sides of the brush device 68 just as shown in the device 20 in FIG. 3, although they need not be tilted from the vertical. The front and rear brush assemblies 70, 72 are connected to the top frame 77 top plate 78 which has a fitting 78 to receive a push handle 80. The brush assemblies, frame and fitting define a brush head 75. The front plate 82 of the top frame 77 may be positioned 90 degrees from the top plate 78. The relationship between the weights of the crimped stainless steel bristles is the same as that described above with respect to the device 20.

It is understood that the invention is not limited to the particular construction and arrangement of parts herein illustrated and described, but embraces all such modified forms thereof as come within the scope of the following claims.

I claim:

1. A brush head for removing human cremated remains from a crematory oven, the brush head comprising:

a rigid top frame having a fitting thereon to receive a rearwardly extending brush handle;

a front bristle strip fixed to the top frame and having downwardly extending metal bristles of a first diameter;

a rear bristle strip fixed to the top frame rearwardly of the front bristle strip and having downwardly extending metal bristles of a second diameter which is greater than the first diameter;

a first side bristle strip fixed with respect to the front bristle strip and extending sidewardly and upwardly therefrom; and a second side bristle strip fixed with respect to the front bristle strip and extending sidewardly and upwardly therefrom and opposite the first side bristle strip, wherein the brush head is configured to operate in temperatures up to 1,800 degrees F., and wherein the front bristle strip is spaced from the rear bristle strip by the first side bristle strip and the second side bristle strip which are positioned therebetween such that a gap is defined between the front bristle strip and the rear bristle strip.

2. The brush head of claim 1 wherein the bristles of the front bristle strip, the rear bristle strip, the first side bristle strip and the second side bristle strip are crimped stainless steel bristles.

3. The brush head of claim 1 wherein the bristles of the first side bristle strip and the second side bristle strip are of the second diameter.

4. The brush head of claim 1 wherein the rigid top frame comprises:

a top plate; and a downwardly extending front plate, and wherein the front bristle strip is fixed to the front plate, and wherein the fitting is fixed to the top plate.

5. The brush head of claim 4 wherein the angle between the top plate and the front plate of the rigid top frame is between about 100 and 110 degrees.

6. The brush head of claim 4 wherein the front bristle strip bristles extend downwardly from a metal channel back which defines a horizontal level, and wherein the first side bristle strip bristles extend downwardly from a metal channel back which is fixed at an upward incline of about thirty degrees from the horizontal level.

7. The brush head of claim 1 wherein the second diameter is at least about 50 percent greater than the first diameter.

8. A brush assembly for removing human cremated remains from a crematory oven, the brush assembly comprising:

a top frame having a top plate and a front plate extending downwardly therefrom at a first angle;

a handle mounted to the top frame and extending rearwardly therefrom;

a front brush assembly fixed to the top frame and having downwardly extending metal bristles of a first diameter;

a rear brush assembly fixed to the top frame rearwardly of the front brush assembly and having downwardly extending metal bristles of a second diameter which is greater than the first diameter;

a first side brush assembly fixed with respect to the front brush assembly and extending sidewardly and upwardly therefrom; and a second side brush assembly fixed with respect to the front brush assembly and extending sidewardly and upwardly therefrom and opposite the first side brush assembly, wherein the brush assembly is configured to operate in temperatures up to 1,800 degrees F., wherein the first side brush assembly and the second side brush assembly are positioned between the front brush assembly and the rear brush assembly to define a gap between the front brush assembly and the rear brush assembly.

9. The brush assembly of claim 8 wherein the bristles of the front brush assembly, the rear brush assembly, the first side brush assembly and the second side brush assembly are crimped stainless steel bristles.

10. The brush assembly of claim 8 wherein the bristles of the first side brush assembly and the second side brush assembly are of the second diameter.

11. The brush assembly of claim 8 wherein the front brush assembly is fixed to the front plate.

12. The brush assembly of claim 8 wherein the angle between the top plate and the front plate of the top frame is between about 100 and 110 degrees.

13. The brush of claim 8 wherein the second diameter is at least about 50 percent greater than the first diameter.

14. The brush assembly of claim 8 wherein the front brush assembly bristles extend downwardly from a metal channel back which defines a horizontal level, and wherein the first side brush assembly bristles extend downwardly from a metal channel back which is inclined upwardly about thirty degrees from the horizontal level.

15. A brush assembly for removing cremated remains from a hot crematory oven, the brush assembly comprising:

a top frame having a top plate and a front plate extending downwardly therefrom at a first angle;

a handle mounted to the top frame and extending rearwardly therefrom;

a front bristle strip fixed to the top frame and having downwardly extending metal bristles of a first diameter; and a rear bristle strip fixed to the top frame rearwardly of the front bristle strip brush-assembly and having downwardly extending metal bristles of a second diameter which is at least about 50 percent greater than the first diameter, wherein the brush assembly is configured to operate in temperatures up to 1,800 degrees F.;

a first side bristle strip fixed to the front bristle strip and extending sidewardly and upwardly therefrom; and a second side bristle strip fixed to the front bristle strip and extending sidewardly and upwardly therefrom and opposite the first side bristle strip, wherein the front bristle strip is fixed to the first side bristle strip and the second side bristle strip and the rear bristle strip is fixed to the first side bristle strip and the second side bristle strip such that a gap is defined between the front bristle strip and the rear bristle strip.

16. The brush assembly of claim 15 wherein the bristles of the front bristle strip, the rear bristle strip, the first side bristle strip and the second side bristle strip are crimped stainless steel bristles.

17. The brush assembly of claim 16 wherein the front bristle strip bristles extend downwardly from a metal channel back which defines a horizontal level, and wherein the first side bristle strip bristles extend downwardly from a metal channel back which is inclined upwardly about 30 degrees from the horizontal level.

18. A brush head for removing human cremated remains from a crematory oven, the brush head comprising:

a rigid top frame having a fitting thereon to receive a rearwardly extending brush handle;

a front bristle strip fixed to the top frame and having downwardly extending metal bristles of a first diameter;

a rear bristle strip fixed to the top frame rearwardly of the front bristle strip and having downwardly extending metal bristles of a second diameter which is less than the first diameter;

a first side bristle strip fixed with respect to the front bristle strip and extending sidewardly and upwardly therefrom; and a second side bristle strip fixed with respect to the front bristle strip and extending sidewardly and upwardly therefrom and opposite the first side bristle strip, wherein the brush head is configured to operate in temperatures up to 1,800 degrees F., and wherein the front bristle strip is spaced from the rear bristle strip by the first side bristle strip and the second side bristle strip which are positioned therebetween and fixed thereto such that a gap is defined between the front bristle strip and the rear bristle strip.

19. The brush head of claim 18 wherein the first diameter is at least about 50 percent greater than the second diameter.

20. The brush head of claim 18 wherein the front bristle strip bristles extend downwardly from a metal channel back which defines a horizontal level, and wherein the first side bristle strip bristles extend downwardly from a metal channel back which is inclined upwardly about thirty degrees from the horizontal level.

* * * * *